US006743113B2

(12) United States Patent
Pettinga et al.

(10) Patent No.: US 6,743,113 B2
(45) Date of Patent: Jun. 1, 2004

(54) GOLF BALL RETRIEVER

(76) Inventors: David Alan Pettinga, 6380 SE. Mariner Sands Dr., Stuart, FL (US) 34997; Bonnie Jo Pettinga, 6380 SE. Mariner Sands Dr., Stuart, FL (US) 34997

( * ) Notice: Subject to any disclaimer, the term of this patent is extended or adjusted under 35 U.S.C. 154(b) by 0 days.

(21) Appl. No.: 10/177,686

(22) Filed: Jun. 21, 2002

(65) Prior Publication Data

US 2003/0236129 A1 Dec. 25, 2003

(51) Int. Cl.[7] ..... A63B 57/00
(52) U.S. Cl. ..... 473/286; 473/409; 294/19.2
(58) Field of Search ..... 473/286, 285, 473/297, 282; 294/19.2

(56) References Cited

U.S. PATENT DOCUMENTS 3,318,628 A * 5/1967 White ..... 294/19.2
3,698,720 A * 10/1972 Gudmundsen ..... 473/286
4,334,707 A * 6/1982 Phillips ..... 294/19.2
4,669,726 A * 6/1987 Lempio ..... 473/299
4,854,592 A * 8/1989 Milovic ..... 473/286
5,004,240 A * 4/1991 Tsukamoto ..... 473/286
5,924,175 A 7/1999 Lippitt et al.
6,059,334 A 5/2000 LaCourse et al.
6,171,202 B1 1/2001 Schmitt
6,190,265 B1 2/2001 Schmitt
2002/0155897 A1 * 10/2002 Schmitt
2003/0207723 A1 * 11/2003 Jacoby ..... 473/298

* cited by examiner

*Primary Examiner*—Stephen Blau
(74) *Attorney, Agent, or Firm*—Brooks Kushman P.C.

(57) ABSTRACT

The present invention discloses a golf ball retriever for engaging and retrieving a golf ball from a cup. The golf ball retriever includes a fitting having an inner bore being affixed to an end of a golf club shaft, a plug sized to be received within the golf club shaft, a plurality of wires secured to the plug and extending through the fitting inner bore, and a plurality of contact elements each being attached to one of the wires. A user extends the wires from the golf club shaft to a position retained by engagement of the plug and fitting, wherein the wires diverge in order to receive the golf ball upon being urged therein for retrieving the golf ball from the cup.

14 Claims, 3 Drawing Sheets

GOLF BALL RETRIEVER

BACKGROUND OF THE INVENTION

1. Field of the Invention

The present invention relates to a golf ball retriever for engaging and retrieving a golf ball from a cup.

2. Background Art

In a typical game, a golf ball is played on each hole until it reaches its destination, a cup in a putting green. Typically, the ball is not retrieved by a user until it is disposed within the cup. The act of retrieving the golf ball may be uncomfortable and inconvenient to the user, requiring the user to repetitively bend over or kneel to reach within the cup. Often, the cup is recessed in moist soil and it is undesirable if contact with the perimeter besmirches the hand or glove of the user. Subsequent to inclement weather, the cup may be filled with precipitation run off or the like.

The prior art provides an assortment of golf ball retrievers for overcoming the inconveniences of retrieving a golf ball from a cup. Traditional golf ball retrievers may be complex, often requiring multiple components and corresponding manufacturing processes. These traditional golf ball retrievers tend to be costly relative to the convenience which they provide.

Some conventional golf ball retrievers are sold as being unitary with a putter. However, these retrievers limit the selection of a putter to one having a golf ball retriever incorporated therein. Other golf ball retrievers are sold separate from the putter such that a user may install it in any putter, or any other golf club for that matter. However, these golf ball retrievers and the assembly process required may be costly and overly burdensome to the user. Further, these golf ball retrievers may require much alteration to the golf club shaft which may be undesirable to the user.

Provisions have been made in the past to address the convenience and comfort of a user when retrieving a golf ball from a cup. Prior art golf ball retrievers have offered such convenience in a discreet compact retriever. However, these designs are costly and/or tedious to install. Accordingly, it is the goal of the present invention to provide a simple, low-cost golf ball retriever that is easy to install with a golf club shaft and convenient for use.

Prior art golf ball retriever apparatuses are disclosed in U.S. Pat. Nos. 6,171,202 and 6,190,265, both issued to Schmitt on Jan. 9, 2001 and Feb. 20, 2001 respectively. The '202 patent discloses a discreet plug to be fixed within a shaft, or a plurality of wires having shoulders oriented thereon for providing a limit to the downward travel of the apparatus. The '265 patent discloses a thread oriented about the wires for enhancing the retention of the ball. These features add manufacturing complexities having adverse economic effects on the interests of the manufacturer.

SUMMARY OF THE INVENTION

It is an object of the invention to provide a golf ball retriever comprising a fitting to be affixed to an end of a golf club shaft, a plug to be received within the golf club shaft, a plurality of wires secured to the plug extending from the fitting, and a plurality of contact elements, each being attached to one of the wires. A user extends the wires from the golf club shaft to an upward position, limited by the plug retained within the golf club shaft, wherefrom the wires diverge in order to receive the golf ball.

Another aspect of the invention includes a cutter and golf ball retriever assembly for installing the golf ball retriever within a golf club. The cutter comprises a longitudinal body, a shank extending from a first end of the body, a cylindrical cutting element extending from the other end, a center guide pin concentric with the cutting element, and a contact surface located on the body. The user secures the shank within a power tool, inserts the center pin into an end of the golf club shaft and imparts a cutting action to the cutter.

A further object of the invention is to provide a golf ball retriever that may be affixed to an end of a golf club shaft or an end of a telescopic shaft.

These and other advantages of the present invention will become apparent to one of ordinary skill in the art in light of the following description and attached drawings.

DETAILED DESCRIPTION OF THE PREFERRED EMBODIMENT

Figure 1:
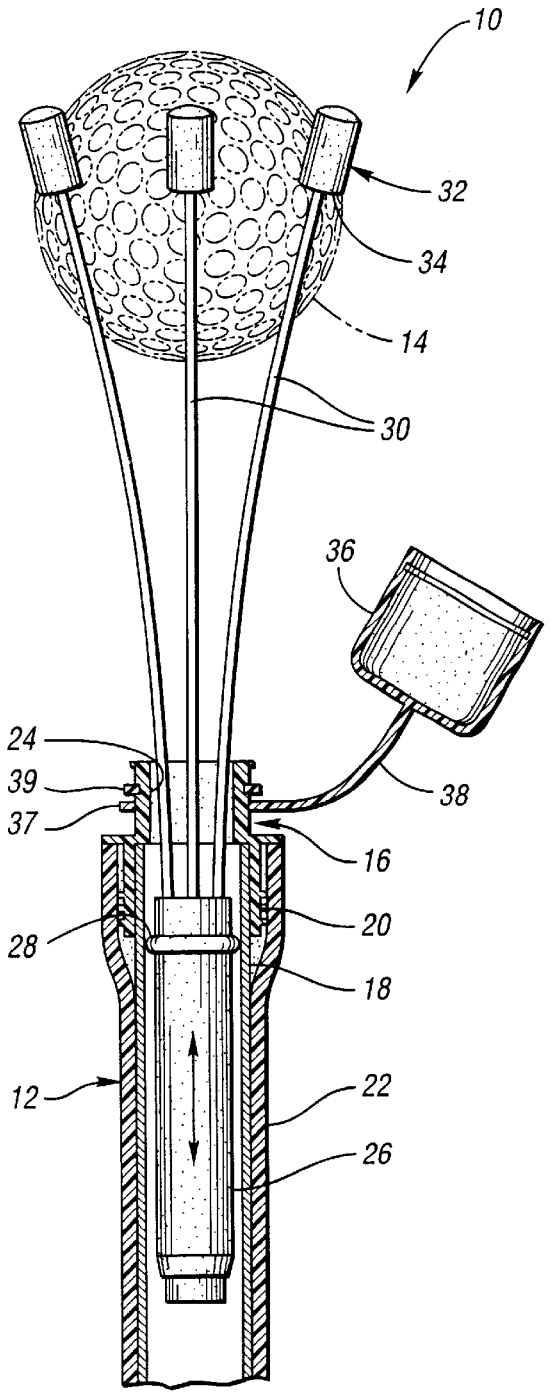
FIG. 1 is a partial longitudinal section view of the golf ball retriever within the scope of the present invention, illustrated in its use with a golf ball and installed within a golf club.

FIG. 1 illustrates an exemplary embodiment of a golf ball retriever 10 within the scope of the present invention. The golf ball retriever 10 is illustrated installed within an end of a golf club 12. Further, the golf ball retriever 10 is illustrated having a golf ball 14 disposed therein. The golf ball retriever 10 is oriented at an end of the golf club 12 proximate to a handle of the golf club. Thus, the golf ball retriever 10 is readily accessible to the user for retrieving a golf ball 14 from the cup.

The golf ball retriever 10 is a simple apparatus for easy installation with a golf club 12. Moreover, the golf ball retriever 10 is a universal design such that the golf ball retriever may be installed within any golf club. Presumably, the user would install the golf ball retriever 10 within a putter such that the golf ball retriever 10 is at hand when required for retrieving the golf ball 14 from the cup.

The golf ball retriever 10 includes a fitting 16 adapted to be affixed to an end of a golf club shaft 18. Specifically, the fitting is illustrated as having a lower annular portion 20 sized to be pressed and retained about the end of the golf club shaft 18. The lower annular portion 20 is sized to fit within a grip 22 wrapped or formed about the golf club shaft 18. Accordingly, the lower annular portion 20 has a thickness sufficient to affix the fitting 16 to the golf club shaft 18, yet thin enough to be enclosed within the grip 22. Further, the lower annular portion 20 includes a plurality of annular lips formed thereabout for engagement within the grip 22. Once installed, the fitting 16 inconspicuously sits atop the golf club shaft 18 and does not upset the aesthetics of the golf club 12.

Although the fitting 16 is illustrated having a lower annular portion 20 adapted to be received about the end of the golf club shaft 18 and enclosed within the grip 22, it would be obvious to one having ordinary skill in the art to affix the fitting 16 to the golf club shaft 18 in a varying manner. For example, the fitting 16 could include a lower annular portion sized to be pressed and retained within the internal diameter of the golf club shaft 18.

The fitting 16 further includes an inner bore 24 formed therethrough, generally coaxial with the golf club shaft 18. The inner bore 24 provides access to the hollow golf club shaft 18 for displacing a portion of the golf ball retriever 10 therein.

The golf ball retriever 10 includes a plug 26 sized to be received within the golf club shaft 18 for limited longitudinal movement therein. Accordingly, the plug is illustrated having an outside diameter smaller than the inside diameter of the golf club shaft 18. In order to retain the plug 26 within the golf club shaft 18, the plug 26 further includes a retaining ring 28 secured about the plug 26. The retaining ring 28 is sized to be received in an annular recess (not shown) formed about the plug 26. The retaining ring 28 has an outside diameter greater than the inner bore 24. The retaining ring 28 may be a spring clip, O-ring, or the like. This features improves the assembly process of the golf ball retriever 10 such that the plug 26 is inserted through the inner bore 24 of the fitting 16, and then the retaining ring 28 is displaced about the plug 26, thus retaining the plug with respect to the fitting by preventing the plug 26 from travel through and out of the inner bore 24.

Figure 2:
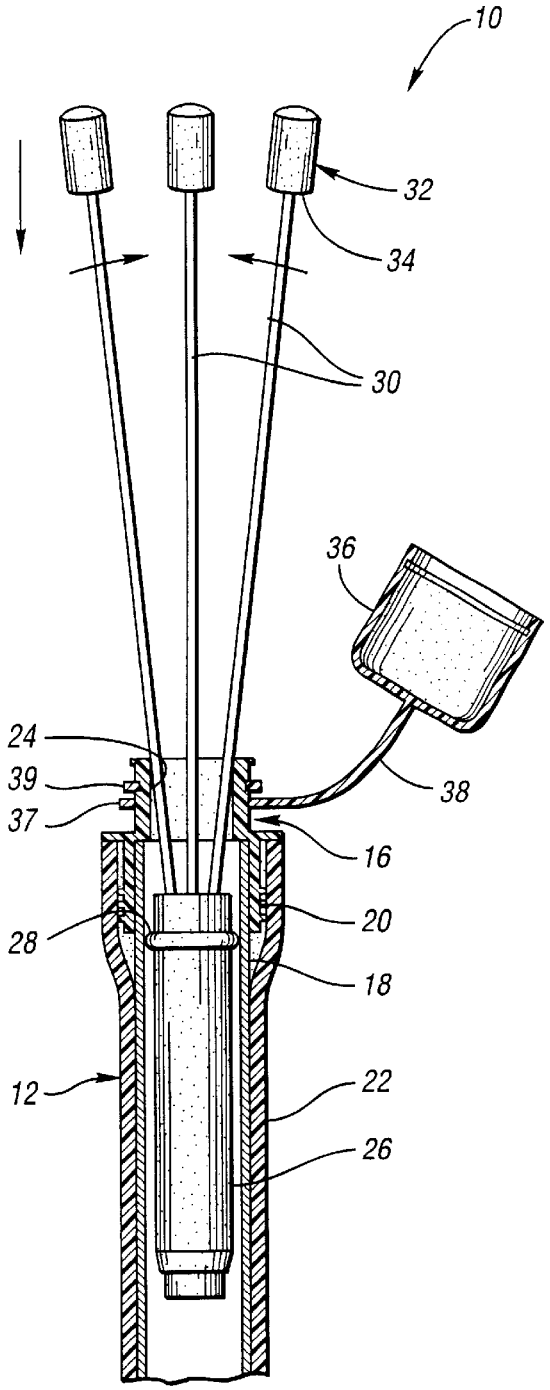
FIG. 2 is a partial longitudinal section view of the golf ball retriever of FIG. 1, illustrated in an extended position.

The golf ball retriever 10 includes a plurality of wires 30 extending through the inner bore 24. The wires 30 each have a first end secured to the plug 26. The wires 30 are secured to the plug 26 in a manner such that the wires 30 generally describe an imaginary frusto-conical surface in an unstressed condition of the wires 30, as illustrated in FIG. 2. This feature can be attained in manufacturing by orienting the wires 30 in the frusto-conical manner and injection molding a plug 26 thereabout, thus maintaining this orientation of the wires 30 in an unstressed condition.

The plurality of wires 30 are illustrated as a quantity of six wires 30. Six is a sufficient number of wires 30, such that each wire has a gauge adequate for flexing, if desired, to receive the golf ball 14 therein and retaining the golf ball 14, yet still fit within the inner bore 24 in a constricted manner for extending substantially within the golf club shaft 18.

A plurality of contact element 32 are attached to the second ends of the wires 30. The contact elements 32 are preferably generally cylindrical in shape, thus having an external grip surface for gripping the golf ball 14 and a lower shoulder 34 for engaging a top surface of the fitting 16. The lower shoulder 34 limits the downward travel of the plug 26 and wires 30. The contact elements 32 are formed from an elastomeric material to provide an adequate co-efficient of friction about the grip surface.

The operation of the golf ball retriever 10 is best understood with reference to FIGS. 1–5. The plug 26, wires 30 and contact elements 32 have a range of longitudinal movement relative to the golf club shaft 18. Once in the retracted position, illustrated in FIG. 2, the user uses the golf club 12 to urge the contact elements 32 against the golf ball 14. Due to the axial load applied to the golf ball retriever 10 by the user, each wire 30 flexes outward, as illustrated by the outward facing arrow in FIG. 4, to receive the golf ball 14. Due to the stressed condition of the wires 30, each wire individually applies a resultant force against the golf ball 14 thus retaining the golf ball 14 therein. A golf ball retriever 10 should be biased against the golf ball 14 in a manner such that the contact elements 32 at least reach the equator of the golf ball, or further, to securely retain the golf ball 14. This retention allows the user to retrieve the golf ball 14 from the cup.

Figure 3:
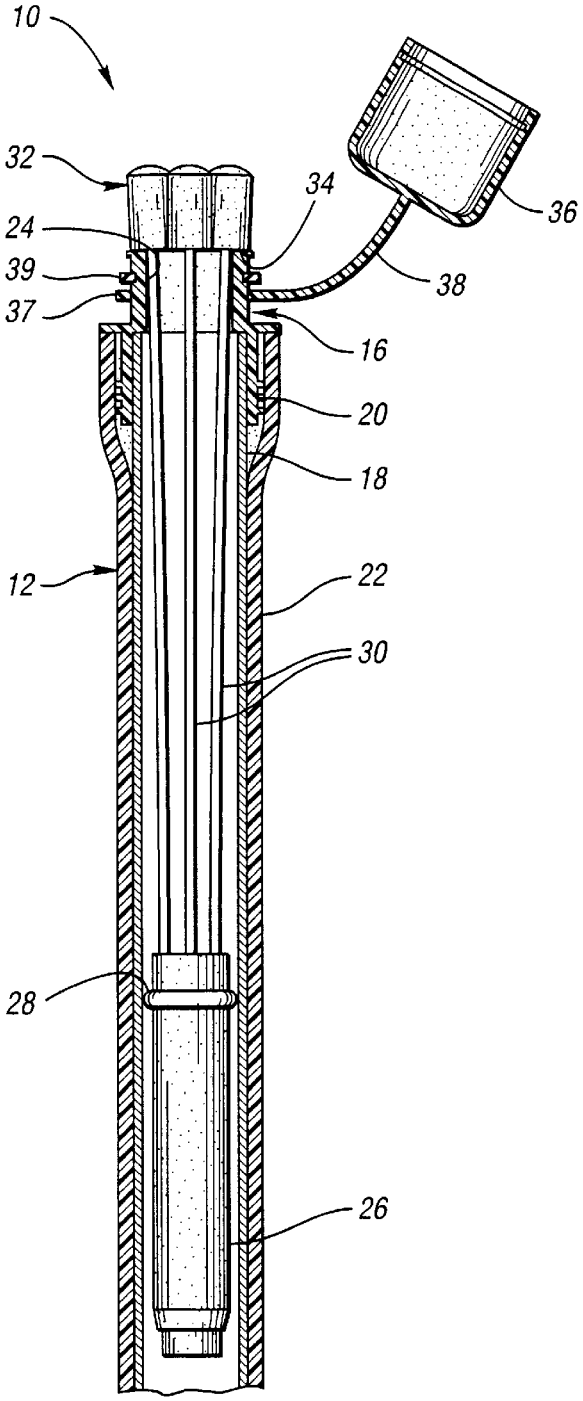
FIG. 3 is a partial longitudinal section view of the golf ball retriever of FIG. 1, illustrated in a retracted position.
Figure 4:
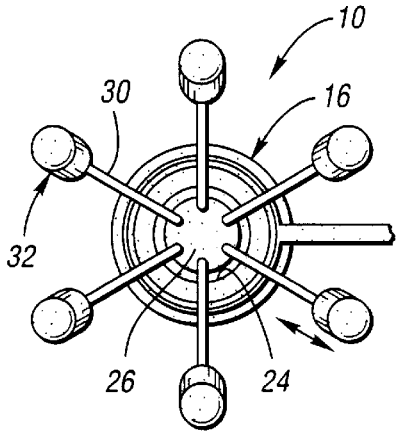
FIG. 4 is a top plan view of the golf ball retriever of FIG. 2.
Figure 5:
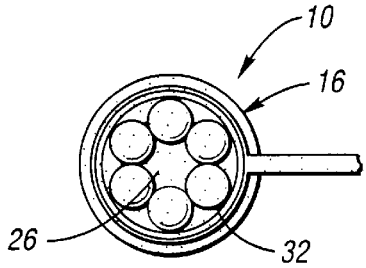
FIG. 5 is a top plan view of the golf ball retriever of FIG. 3.

Once the golf ball 14 is retrieved and manually removed from the golf ball retriever 10, the user may store the golf ball retriever 10 for convenience and compactness. To do so, the user biases the wires 30 and/or contact elements 32 in a downward direction as indicated by the arrow on FIG. 2. The inner bore 24 urges each wire 30 inwards as indicated by the arrows in FIG. 2 causing the wires 30 to constrict for orientation within a golf club shaft 18. It may be desired that the user may bias the contact elements 32 and/or wires 30 inwards while pressing them within the shaft to overcome friction forces exerted on each wire 30 by the inner bore 24. The shoulders 34 of the contact elements 32 engage the upper surface of the fitting 16 thus preventing further downward travel as illustrated in FIGS. 3 and 5.

Figure 6:
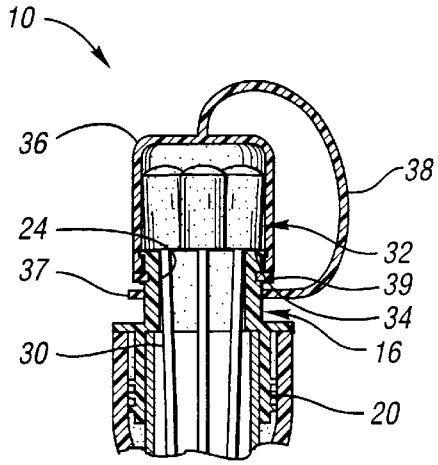
FIG. 6 is a partial longitudinal section view of the golf ball retriever of FIG. 1, illustrating the retracted position with a cap enclosing a top region of the golf ball retriever.
Figure 7:
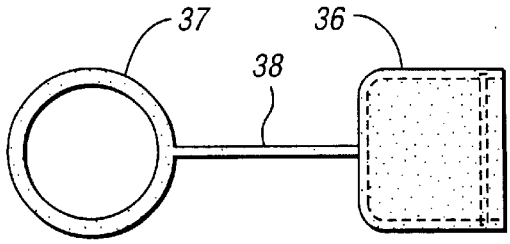
FIG. 7 is a top plan view of the cap of FIG. 1.

When the user desires to employ the golf ball retriever 10, the user merely pulls the contact elements 32 upwards such that the wires 30 extend through the inner bore 24 until the retaining ring 28 of plug 26 contacts the fitting 16. In order to enhance the storing, aesthetics, and protection of the golf ball retriever 10, a cap 36 is provided for containing the contact elements 32 and a top region of fitting 16 as illustrated in FIGS. 6 and 7. The cap 36 is secured to the fitting 16 by a cap ring 37 and a tether 38. The cap ring 37 is sized to fit over the fitting 16 and is secured to the fitting 16 by a retaining ring 39. The retaining ring 39 may be a spring clip, O-ring, or the like. Alternatively, the fitting 16, cap 36 and tether 38 may be formed integrally by an injection molding process and may be formed of nylon, a high strength of polymer, or the like, thus eliminating the cap ring 34 and retaining ring 39.

Figure 8:
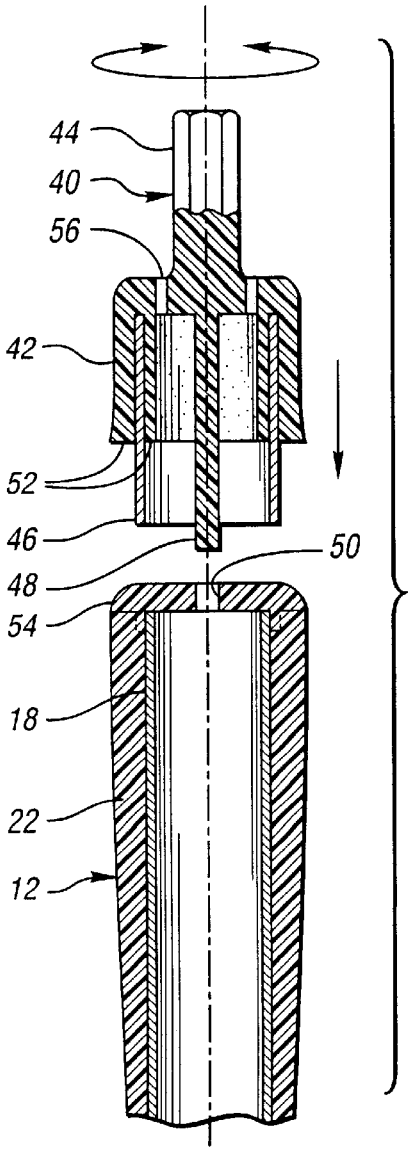
FIG. 8 is a partial longitudinal view of a golf club and a cutter for installing the golf ball retriever in the golf club.

Referring now to FIG. 8, the installation of the golf ball retriever 10 is discussed in detail. A cutter 40 is illustrated for modifying the golf club 12 for installation of the golf ball retriever 10. The golf ball retriever 10 and cutter 40 may be sold together as an assembly.

The cutter 40 includes a longitudinal body 42 having a shank 44 extending coaxially from a first end of the body 42, and a cutting element 46 extending from a second end of the body 42. The shank 44 is sized to be received within a power tool. Further, the shank 44 has a hexagonal profile such that, alternatively, a hand tool may be used. The cutting element 46 is cylindrical and has an internal diameter slightly greater than an external diameter of the golf club shaft 18. The invention contemplates that the cutting element 46 may have an external diameter slightly smaller than the internal diameter of the golf club shaft.

The cutter 40 includes a center guide pin 48 extending axially within and concentrically with the cutting element 46. The center guide pin acts as a pilot for centering and aligning the cutting element 46. Further, the center guide pin 48 is sized to be received within a standard aperture 50 formed within the grip 22 of the golf club 12.

A contact surface 52 is located on the body 42 for limiting the depth of the cut. The contact surface 52 may be an annular ring oriented about the cutting element 46 for engaging a portion of the grip 22, and/or the contact surface 52 may be an annular ring oriented within the cutting element for engaging a top surface of the grip 22 or the golf club shaft 18, or the like.

The cutter 40 imparts a cutting action from the power tool to the grip 22 of the golf club 12. The cutting action may be a rotary cutting action illustrated by the rotational arrow in FIG. 7 in combination with a downward force illustrated by the downward arrow. Alternatively, the cutting action may be defined as a punching action delivered in the direction of the downward arrow.

The invention contemplates that the cutter may be used on any golf club 12 having a continuous grip 22 or a discreet grip 22 having a top plug 54 illustrated by the phantom line within grip 22. Accordingly, once a portion of the grip 22 is cut out, and removed, the golf club 12 is prepared for installation of a golf ball retriever 10 thereto. It is conceivable that the cut out from the grip 22 or other debris may remain within the cutting element 46 subsequent to the cutting operation. Therefore, the body 42 may include at least one aperture 56 formed therethrough for removing debris from the cutting element 46.

Figure 9:
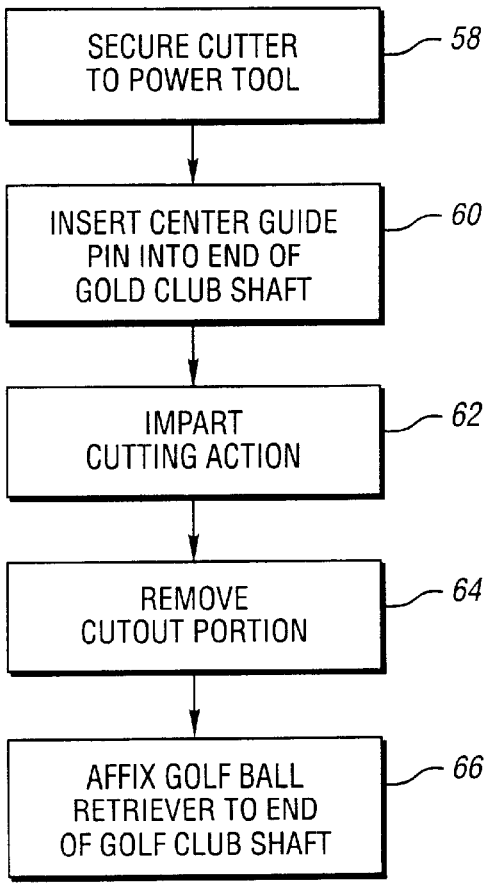
FIG. 9 is a flow chart depicting a method for installing a golf ball retriever within a golf club.

Referring now to FIG. 9, a method for installing the golf ball retriever 10 within the golf club 12 is illustrated. The method includes block 58, securing the cutter 40 to the power tool. Then, inserting the center guide pin 48 into the end of the golf club shaft 18 as set forth in block 60. Next, depicted in block 62, a cutting action is imparted from the power tool to the cutter 40. Next, block 64 describes removing a cut out portion from the golf club shaft 18. Block 66 requires affixing the golf ball retriever 10 to the end of the golf club shaft 18.

It would be obvious to one having ordinary skill in the art to affix the golf ball retriever 10 to a shaft other than that of a golf club. For example, the golf ball retriever 10 may be affixed to a telescopic shaft for retrieving a golf ball 14 from a hard to reach location. The telescopic shaft is well known in the art as a unitary tool, separate from the golf clubs, for retrieving golf balls 14. Accordingly, with reference to FIG. 1, the shaft depicted by reference numeral 18 may be a golf club shaft, a telescopic shaft, or the like. The invention contemplates that the golf ball retriever 10 may be affixed to the telescopic shaft with or without the external grip 22.

In summary, the present invention offers a simplified, low-cost golf ball retriever 10 for improving the convenience of the user and overcoming disadvantages of the prior art. Further, the golf ball retriever 10 and the cutter 40 provide for easily obtainable installation of the simplified golf ball retriever 10 within the golf club 12.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A golf ball retriever for engaging and retrieving a golf ball from a cup, the golf ball retriever comprising:

a fitting adapted to be affixed to an end of a golf club shaft, the fitting having an inner bore therethrough, generally coaxial with the golf club shaft, the fitting including a lower annular portion with a plurality of annular tips formed on the outside thereof for engagement with the inside of the grip, the lower annular portion being adapted to be affixed about the end of the golf club shaft and enclosed within the grip;

a plug sized to be received within the golf club shaft and retained by the fitting for limited longitudinal movement within the shaft;

a retaining ring secured about the plug, the retaining ring having an outside diameter greater than the inner bore of the fitting for retaining the plug within the golf club shaft;

a plurality of wires extending through the fitting inner bore, each having a first end secured to the plug and each having a second end; and a plurality of contact elements, each contact element being attached to the second end of one of the wires, each contact element having an external grip surface for engaging the golf ball and each contact element having a lower shoulder;

whereby a user extends the wires from the golf club shaft to an upward position relative to the golf club shaft, the upward travel of the wires being limited by the retaining ring mounted on the plug retained within the golf club shaft, wherein the wires diverge in order to receive the golf ball upon being urged therebetween, the golf ball being engaged by frictional contact between it and the contact elements prior to retrieval of the golf ball from the cup.

2. The golf ball retriever of claim 1, wherein the contact elements are further defined as being generally cylindrical, each having an outer cylindrical surface defining the external grip surface and a lower surface orthogonal to the wire defining the lower shoulder.

3. The golf ball retriever of claim 1, wherein the wires have a range of motion defined between a retracted position wherein the wires are constricted by engagement within the inner bore of the fitting and the wires substantially extend within the golf club shaft such that the lower shoulders of the contact elements engage an upper surface of the fitting adjacent to the inner bore, and an extended position wherein the wires substantially extend from the golf club shaft and diverge generally describing an imaginary frusto-conical surface.

4. The golf ball retriever of claim 1, further comprising a cap and a tether connecting the cap to the fitting, the cap being sized to enclose a top region of the fitting and the contact elements in a retracted position of the wires.

5. The golf ball retriever of claim 1, wherein the plurality of wires comprises no more than six wires.

6. An assembly for installing a golf bail retriever into a shaft of a golf club, the assembly comprising:

a cutter including:

a longitudinal body;

a shank extending coaxially from a first end of the body, the shank being sized to be received within a power tool;

a cylindrical cutting element extending from a second end of the body;

a center guide pin extending axially within and concentrically with the cutting element; and a contact surface located on the body, proximate to the cutting element;

wherein a user secures the shank within the power tool, inserts the center pin into an end of a golf club shaft for centering and aligning the cutting element relative thereto, and imparts a cutting action to the cutter; and a golf ball retriever including:

a fitting adapted to be affixed to an end of a golf club shaft, the fitting having an inner bore therethrough, generally coaxial with the golf club shaft, the fitting including a lower annular portion with a plurality of annular rips formed on the outside thereof for engagement with the inside of the grip, the lower annular portion being adapted to be affixed about the end of the golf club shaft and enclosed within the grip;

a plug sized to be received within the golf club shaft and retained by the fitting for limited longitudinal movement within the shaft;

a retaining ring secured about the plug, the retaining ring having an outside diameter greater than the inner bore of the fitting for retaining the plug within the golf club shaft;

a plurality of wires extending through the fitting inner bore, each having a first end secured to the plug and each having a second end; and a plurality of contact elements, each contact element being attached to the second end of one of the wires, each contact element having an external grip surface for engaging the golf ball and each contact element having a lower shoulder;

whereby a user extends the wires from the golf club shaft to an upward position relative to the golf club shaft, the upward travel of the wires being limited by the retaining ring mounted on the plug retained within the golf club shaft, wherein the wires diverge in order to receive the golf ball upon being urged therebetween, the golf ball being engaged by frictional contact between it and the contact elements prior to retrieval of the golf ball from the cup.

7. The assembly of claim 6, wherein the cutting action is further defined as a rotary cutting action.

8. The assembly of claim 6, wherein the cutting action is further defined as a punching action.

9. The assembly of claim 6, wherein the contact surface is further defined as an annular ring oriented about the cutting element.

10. The assembly of claim 6, wherein the contact surface is further defined as an annular ring oriented within the curling element.

11. The assembly of claim 6, wherein the first end of the body further includes at least one aperture formed therethrough for removing debris from within the cutting element.

12. A golf ball retriever for engaging and retrieving a golf ball, the golf ball retriever comprising:

a fitting adapted to be affixed to an end of a telescopic shaft, the fitting having an inner bore therethrough, generally coaxial with the telescopic shaft, the fitting including a lower annular portion with a plurality of annular tips formed on the outside thereof for engagement with the inside of the grip, the lower annular portion being adapted to be affixed about the end of the golf club shaft and enclosed within the grip;

a plug sized to be received within the telescopic shaft and a retaining ring secured about the plug, the retaining ring having an outside diameter greater than the inner bore of the fitting for retaining the plug within the golf club shaft;

a plurality of wires extending through the fitting inner bore, each having a first end secured to the plug and each having a second end; and a plurality of contact elements, each contact element being attached to the second end of one of the wires, each contact element having an external grip surface for engaging the golf ball and each contact element having a lower shoulder;

wherein the user extends the wires from the telescopic shaft to an upward position relative to the telescopic shaft, the upward travel of the wires being limited by the plug retained within the telescopic shaft, wherein the wires diverge in order to receive the golf ball upon being urged therein, the golf ball being engaged by frictional contact between it and the contact elements prior to retrieval of the golf ball.

13. An assembly for installing a golf ball retriever into a telescopic shaft, the assembly comprising:

a cutter including:

a longitudinal body;

a shank extending coaxially from a first end of the body, the shank being sized to be received within a power tool;

a cylindrical cutting element extending from a second end of the body;

a center guide pin extending axially within and concentrically with the cutting element; and a contact surface located on the body, proximate to the cutting element;

wherein a user secures the shank within the power tool, inserts the center pin into an end of a telescopic shaft for centering and aligning the cutting element relative thereto, and imparts a cutting action to the cutter; and a golf ball retriever including;

a fitting adapted to be affixed to an end of a golf club shaft, the fitting having an inner bore therethrough, generally coaxial with the golf club shaft, the fitting including a lower annular portion with a plurality of annular tips formed on the outside thereof for engagement with the inside of the grip, the lower annular portion being adapted to be affixed about the end of the golf club shaft and enclosed within the grin;

a plug sized to be received within the golf club shaft and retained by the fitting for limited longitudinal movement within the shaft;

a retaining ring secured about the plug, the retaining ring having an outside diameter greater than the inner bore of the fitting for retaining the plug within the golf club shaft;

a plurality of wires extending through the fitting inner bore, each having a first end secured to the plug and each having a second end; and a plurality of contact elements, each contact element being attached to the second end of one of the wires, each contact element having an external grip surface for engaging the golf ball and each contact element having a lower shoulder;

whereby a user extends the wires from the golf club shaft to an upward position relative to the golf club shaft, the upward travel of the wires being limited by the retaining ring mounted on the plug retained within the golf club shaft, wherein the wires diverge in order to receive the golf ball upon being urged therebetween, the golf ball being engaged by frictional contact between it and the contact elements prior to retrieval of the golf ball from the cup.

14. A method for installing a golf ball retriever within a golf club, the method comprising:

securing a cutter to a power tool;

inserting a center guide pin of the cutter within an end of a golf club shaft;

imparting a cutting action from the power tool to the cutter;

removing a cutout portion from the golf club shaft; and affixing a golf ball retriever to the end of the golf club shaft, the golf ball retriever comprising:

a fitting adapted to be affixed to an end of a golf club shaft, the fitting having an inner bore therethrough, generally coaxial with the golf club shaft, the fitting including a lower annular portion with a plurality of annular tips formed on the outside thereof for engagement with the inside of the grip, the lower annular portion being adapted to be affixed about the end of the golf club shaft and enclosed within the grip;

a plug sized to be received within the golf club shaft and retained by the fitting for limited longitudinal movement within the shaft;

a retaining ring secured about the plug, the retaining ring having an outside diameter greater than the inner bore of the fitting for retaining the plug within the golf club shaft;

a plurality of wires extending through the fitting inner bore, each having a first end secured to the plug and each having a second end; and a plurality of contact elements, each contact element being attached to the second end of one of the wires, each contact element having an external grip surface for engaging the golf ball and each contact element having a lower shoulder.

* * * * *

UNITED STATES PATENT AND TRADEMARK OFFICE

CERTIFICATE OF CORRECTION

PATENT NO. : 6,743,113 B2
DATED : June 1, 2004
INVENTOR(S) : David Alan Pettinga et al.

It is certified that error appears in the above-identified patent and that said Letters Patent is hereby corrected as shown below:

Column 7,
Line 39, delete “curling” and insert therefor -- cutting --,

Column 8,
Line 36, delete “grin” and insert therefor -- grip --.

Signed and Sealed this

Third Day of August, 2004

JON W. DUDAS
*Acting Director of the United States Patent and Trademark Office*